United States Patent [19]

Bachmann

[11] 3,977,179

[45] Aug. 31, 1976

[54] DISPLAY MECHANISM FOR TIMEPIECES

[75] Inventor: Peter Bachmann, Bettlach, Switzerland

[73] Assignee: Ebauches Bettlach S.A., Switzerland

[22] Filed: Apr. 22, 1975

[21] Appl. No.: 570,355

[30] Foreign Application Priority Data

May 6, 1974 Switzerland ..... 6152/74

[52] U.S. Cl. ..... 58/128; 58/58; 40/28 C

[51] Int. Cl.[2] ..... G04B 19/16

[58] Field of Search ..... 58/4 A, 5, 58, 50, 126 R, 58/127 R, 128; 40/28 C, 107

[56] References Cited

UNITED STATES PATENTS

| | | | |
|---|---|---|---|
| 3,258,907 | 7/1966 | Hamblin | 58/126 R |
| 3,399,474 | 9/1968 | Rinder | 40/28 C |
| 3,608,300 | 9/1971 | Wingzer | 58/4 A |
| 3,683,523 | 8/1972 | Boyles | 40/28 C |
| 3,683,524 | 8/1972 | Polonsky et al. | 40/28 C |
| 3,721,087 | 3/1973 | Boyles et al. | 58/50 R |
| 3,783,539 | 1/1974 | Trame | 58/50 R |

*Primary Examiner*—L. T. Hix
*Assistant Examiner*—Vit W. Miska
*Attorney, Agent, or Firm*—Stevens, Davis, Miller & Mosher

[57] ABSTRACT

A timepiece display mechanism having an indicator member on which are formed a series of indicating marks which overlap each other; some of the marks forming different indications are intermingled. The marks are viewed through an aperture which comprises a series of openings distributed along an outline corresponding to a superposition of all the indications; this outline is situated within an angle which has its apex at the center of the indicator member and is greater than an angle obtained by dividing 360° by the total number of indications.

8 Claims, 4 Drawing Figures

FIG. 3
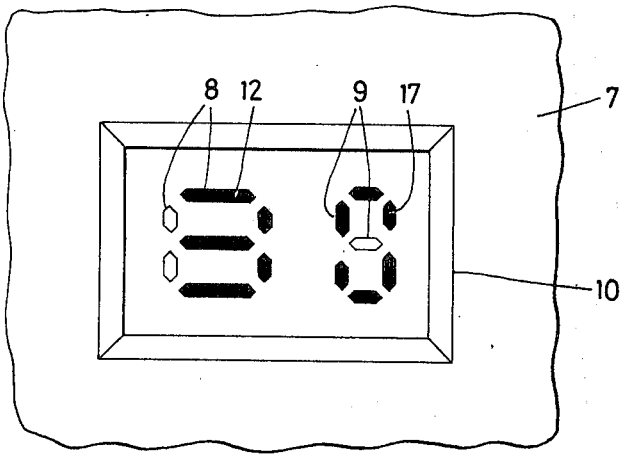
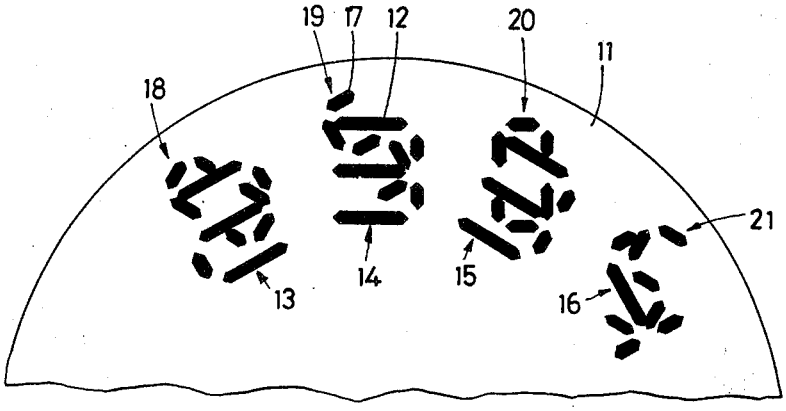
FIG. 4

DISPLAY MECHANISM FOR TIMEPIECES

This invention relates to a numerical or alphabetic display mechanism for timepieces, comprising a dial, an indicator member disposed beneath the dial and adapted to rotate about an axis perpendicular to the dial, and an aperture made in the dial, the indicator member bearing marks intended to appear successively in the aperture as the indicator member rotates.

Most of the known display mechanisms of this kind comprise a combination of an aperture and a rotary disk where the aperture consists of an opening made in the dial of the timepiece, of the same size as the indications to be displayed, and the disk bears the series of such indications inscribed side by side along a circular path which passes beneath the aperture when the indicator member rotates. This display system is in general use, e.g., in calendar watches. It is likewise used in numerous mechanical digital-display watches which comprise a first disk bearing the digits 1 to 12, driven intermittently at the rate of 30° per hour, and a second disk bearing the minute indications, generally shown by fives so as to pass gradually under a respective part of the aperture.

One of the drawbacks of these display systems is that in many cases, the size of the indications must be reduced to such an extent that it becomes difficult to read them. This difficulty has, for instance, made it impossible up to now to produce calendar mechanisms comprising only one calendar-ring moving beneath an aperture in sizes customary for ladies' watches.

It has already been proposed to display time or date indications by means of more than one moving part, with one bearing the units and another the tens. However, the driving mechanisms necessary for operating these moving parts complicate the watch movement and often increase its size, which defeats the intended purpose.

It is the object of this invention to provide a display mechanism of the aforementioned kind which makes it possible to display large-size numerical or alphabetic indications by using an indicator member on which the marks intended to form the various indications overlap, without the display of the desired indications being disturbed thereby.

To this end, in the mechanism according to the present invention, the marks form a series of indications, the aperture comprises a series of openings distributed along an outline corresponding to a superposition of all the indications, this outline is situated within an angle which has its apex at the center of the indicator member and is greater than an angle obtained by dividing 360° by the total number of indications, and at least some of the marks intended to form two different indications are intermingled.

Two possible embodiments of the invention will now be described in detail with reference to the accompanying drawings, in which.

Figure 1:
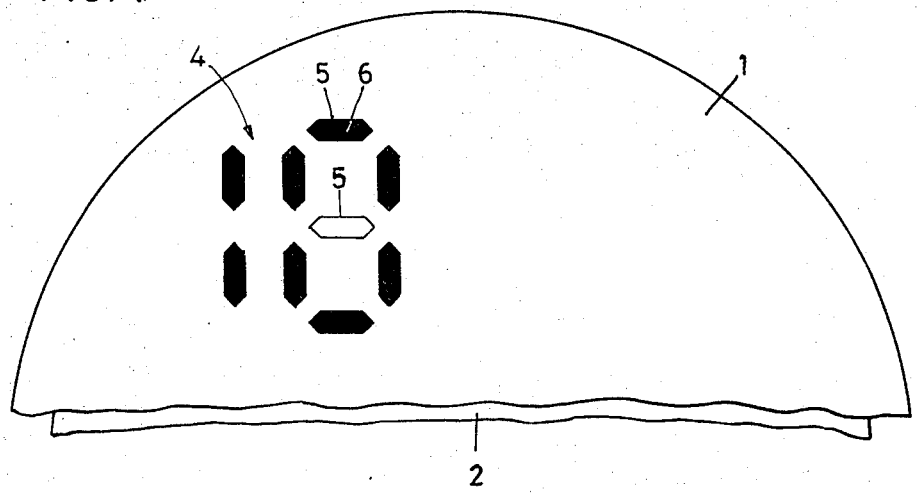
FIG. 1 is a partial top plan view of the first embodiment.
Figure 2:
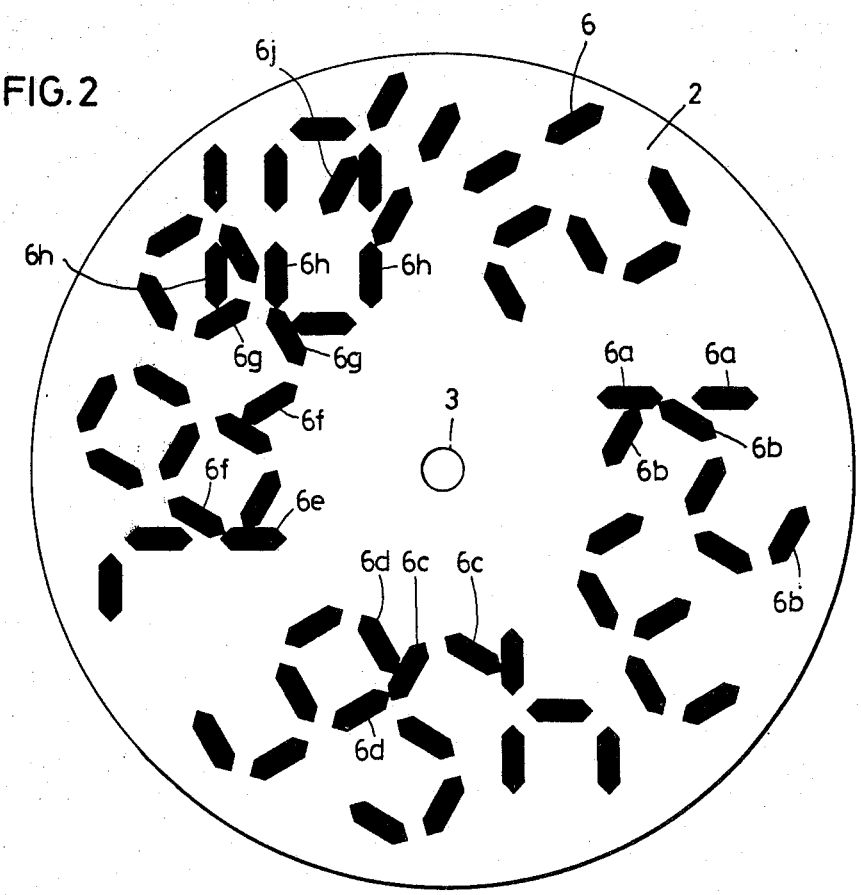
FIG. 2 is a top plan view of the rotary disk of the mechanism shown in FIG. 1, and FIGS. 3 and 4 are analogous views of the second embodiment.

FIGS. 1 and 2 show elements of a watch indicating the time in the form of a digital display. This watch comprises a dial 1 secured above a rotary disk 2, a center opening 3 of which is mounted on a 12-tooth star. Disk 2 is jumped through an angle of 30° every hour. Its drive mechanism is a conventional one which need not be shown in the drawing. Cut out of dial 1 is an aperture designated as a whole by the reference numeral 4 but actually composed of nine openings 5, all the same size and shape. This shape is that of a rectangle with a triangle at each end. Seven of the openings 5 are distributed along an outline representing the digit "8", whereas the last two are aligned with each other to the left of the digit "8" outline so as to form the digit "1". The angle at the center enclosing all of the openings 5 is greater than 30°. The position of the indication "18" formed by openings 5 is at an angle to a radius joining its center to the center of disk 2.

In order to form all the indications of the hours 1 to 12 in aperture 4 successively, disk 2 bears at its periphery marks 6 of the same size and shape as openings 5. Marks 6 contrast with the background of disk 2, which looks the same as dial 1, or at least the same as the area of dial 1 surrounding openings 5. Thus if no mark 6 appears in an opening 5, the latter is practically invisible. If, on the other hand, a mark 6 is directly beneath an opening 5, it is clearly visible. Marks 6 are disposed over the surface of disk 2 in such a way as to cause the digits 1 to 12 to appear successively in aperture 4 when disk 2 rotates through 360° by jumps of 30° each. It will be noted that marks **6*a*, representing the digit "1", are positioned with respect to marks 6*b*, representing the digit "2", in such a way that one of the marks 6*a* is partly engaged in the space between two of the marks 6*b*. The same is true of one of the marks 6*c* forming the digit "5" and two of the marks 6*d* forming the digit "6". One of the marks 6*e* forming the digit "7" is engaged between two marks 6*f* of the digit "8", and one of the marks 6*g* forming the digit "9" extends up to the limit of one of the marks 6*f* of the digit "8". It has therefore been possible to enlarge the indications borne by disk 2** in such a way that the segments forming them are immediately adjacent to one another.

Moreover, one of the marks **6*h* forming the number "10" is completely situated within the outline represented by marks 6*g* forming the digit "9". Another mark 6*h* is partly engaged between two of the marks 6*g*. In the same way, a mark 6*j* is completely situated within the outline defined by marks 6*h***.

It will be obvious that the distribution described above enables groups of marks representing certain indications, e.g., the group representing the number "12", to be accorded an area exceeding that which could be reserved for it if the marks corresponding to the various indications were completely separate from one another on disk 2. If they were supposed to appear in a wide-open aperture like the conventional ones, the marks would necessarily have to be completely separated. Thus the provision of aperture 4 composed of openings 5 makes it possible to increase the size of the time indications.

FIGS. 3 and 4 show an embodiment which likewise illustrates the varied possibilities of application of the principle illustrated in FIGS. 1 and 2. Although this embodiment is not necessarily open to direct practical application, it nevertheless shows that other possibilities remain available, particularly the possibility of application to a calendar-disk.

FIG. 3 shows a dial 7 provided with an aperture composed of two series of openings 8 and 9. Each of these series of openings 8 and 9 forms the digit "8", but in slightly differing dimensions and proportions. Openings 8 and 9 are elongated segments but of different lengths. They are surrounded as a whole by a frame 10, which makes it possible to give the area within frame 10 the same appearance as the background of a disk 11 (FIG. 4) even if the rest of dial 7 is different. Disk 11 bears groups of marks of two different kinds, 12 and 17, forming the indications intended to appear in the aperture. Marks 12 are of two different lengths and correspond to respective openings 8. They are distributed so as to form the digits from 0 to 5, each digit being repeated twice around the contour of disk 11. These various digits are regularly distributed along the periphery of disk 11. The drawing shows a first series of marks numbered 13 and representing the digit "2", a second series 14 and a third series 15, each representing the digit "3", and a fourth series 16 representing the digit "4".

The area of each of these series 13, 14, 15, 16 is partly covered by marks 17 belonging to four other groups of marks numbered 18, 19, 20, 21. It will be seen that groups 18 and 20 represent the digit "0", while groups 19 and 21 represent the digit "5". The sizes and distribution of marks 17 are such that they can appear in openings 9 but not in openings 8, through which only marks 12 can be seen.

It follows from the foregoing that in this second embodiment, an aperture occupying a surface area corresponding to two indications marked on the disk enables all these indications to appear during the course of one revolution of the disk, which clearly demonstrates the saving on space obtained.

Thus in the position represented by FIGS. 3 and 4, it may be seen that openings 8 of the aperture allow the marks 12 forming series 14 to appear, while the zones surrounding openings 8 completely mask the marks 17 forming group 19, even though at least some of these marks are situated within the area covered by series 14. Conversely, series 15 and group 20 partially overlap on disk 11, as may be seen in FIG. 4. Group 20 comprises marks 17 of sizes and shapes corresponding to some of the openings 9 and representing the digit "0", whereas series 15 comprises marks 12 capable of appearing in openings 8. In the position shown in FIG. 3, only the marks forming group 20 are visible through openings 9. The result of the superposition of disk 11 and the aperture surrounded by frame 10 is the appearance of the number "30". This indication covers a surface area which can be accommodated within an angle at the center of about 50°. Now the angle through which disk 11 rotates during each jump, i.e., every 5 minutes, is 30°, and the number of different indications which appear in the aperture is obviously twelve. This example is chosen to show that it is, in fact, possible to superimpose marks representing any digit at all from 0 to 9. In another embodiment, the display mechanism described might be applied to a calendar member comprising a ring rotating by jumps of 1/31 of a revolution per day. The marks borne by the calendar ring, intended to cause the sequence of dates to appear in an aperture of the kind shown in FIG. 3, might be intermingled along the outer margin of the ring, similarly to what is shown in FIG. 4. In that case, the area covered by the aperture might reach up to about 25° instead of about 12°, which is the obligatory limit with the known calendar devices.

In a further embodiment, the area of the dial in which openings 8 and 9 or 5 are cut might be replaced by a circular or rectangular opening, like that of the conventional apertures, surrounded by frame 10. A transparent plate covered with an opaque coating of the same color as the background of the indicator member situated below it would be inserted in the aforementioned opening, the coating being removed at the locations intended to form segments 8 and 9. This plate, made of glass, for instance, might project beneath the dial slightly so as to constitute the only part in immediate proximity to the indicator member. If the opaque coating were applied to the underside of the transparent plate, since there would be no space between that surface and the upper surface of the indicator member bearing the markings, it would be easier to read the indications, which would appear to be in the same plane as the opaque coating.

In still another embodiment, it would obviously be possible to cause partially intermingled indications borne by different indicator members to appear in two series of openings, like openings 8 and 9, of an aperture.

What is claimed is:

1. A display mechanism for timepieces, comprising a dial, an indicator member disposed beneath said dial and adapted to rotate about an axis perpendicular to said dial, and an aperture made in said dial, said indicator member bearing marks intended to appear successively in said aperture as said indicator member rotates, wherein said marks form a series of indications, said aperture comprises a series of openings distributed along an outline corresponding to a superposition of all said indications, said outline is situated within an angle which has its apex at the center of said indicator member and is greater than an angle obtained by dividing 360° by the total number of said indications, and at least some of said marks intended to form two different said indications are intermingled, and wherein at least some of said marks are segments of the same size and shape as said openings.

2. A mechanism according to claim 1, wherein said openings are in the shape of segments, and said outline comprises at least one figure in the shape of an eight.

3. A mechanism according to claim 1, wherein some of said marks are zones larger than said segments.

4. A mechanism according to claim 1, wherein said outline forms the number 18, said series of indications represents numbers from 1 to 12, said segments form the digit 1 of said indications 10 and 11, and said segments forming the digit 9 and the digit 0 of said indication 10 are intermingled.

5. A mechanism according to claim 1, wherein said series of indications represents at least the digits from 0 to 9, and at least one said segment of a said digit constituting one of said indications is partly engaged in a space comprised between two said segments forming an adjacent said indication.

6. A display mechanism for timepieces, comprising a dial, an indicator member disposed beneath said dial and adapted to rotate about an axis perpendicular to said dial, and an aperture made in said dial, said indicator member bearing marks intended to appear successively in said aperture as said indicator member rotates, wherein said marks form a series of indications, said aperture comprises a series of openings distributed along an outline corresponding to a superposition of all said indications, said outline is situated within an angle which has its apex at the center of said indicator member and is greater than an angle obtained by dividing 360° by the total number of said indications, said outline is disposed at an angle to a radius joining its center to the center of said indicator member, and at least some of said marks intended to form two different said indications are intermingled.

7. A display mechanism for timepieces, comprising a dial, an indicator member disposed beneath said dial and adapted to rotate about an axis perpendicular to said dial, and an aperture made in said dial, said indicator member bearing marks intended to appear successively in said aperture as said indicator member rotates, wherein said marks form a series of indications of two-digit numbers, said aperture comprises a series of openings distributed along an outline corresponding to a superposition of all said indications of two-digit numbers, said outline is situated within an angle which has its apex at the center of said indicator member and is greater than an angle obtained by dividing 360° by the total number of said indications, and at least some of said marks intended to form two different said indications are intermingled.

8. A mechanism according to claim 7, wherein said marks are so disposed as to form dates from 01 to 31 in sequence passing successively beneath said aperture.

* * * * *